US005366356A

United States Patent [19]

Volftsun

[11] Patent Number: 5,366,356

[45] Date of Patent: Nov. 22, 1994

[54] ROTARY-VANE MACHINE

[75] Inventor: Leonid Volftsun, Ofakim, Israel

[73] Assignee: Savgal Compressors Ltd., Ofakim, Israel

[21] Appl. No.: 55,094

[22] Filed: May 3, 1993

[30] Foreign Application Priority Data

May 5, 1992 [IL] Israel ..... 101787

[51] Int. Cl.[5] ..... F04C 18/063

[52] U.S. Cl. ..... 418/38; 418/34

[58] Field of Search ..... 418/34, 35, 38; 123/245

[56] References Cited

U.S. PATENT DOCUMENTS 1,330,629 2/1920 Gooding ..... 418/38
2,271,068 1/1942 Gardner ..... 418/38
3,169,487 2/1965 Namikawa ..... 418/34

*Primary Examiner*—Richard A. Beatsch
*Assistant Examiner*—Charles G. Freay
*Attorney, Agent, or Firm*—Lowe, Price, LeBlanc & Becker

[57] ABSTRACT

A rotary-vane machine including a first and a second stationary end member connectable to one another, a rotor body contacting one face of the first end member and having a first shaft rotatably mounted in the first end member, at least two first vanes located inside the rotor body and rigidly connected thereto, a rotor cover plate fluid-tightly attachable to the rotor body, a second shaft mounted in, and extending beyond, the rotor body and rotor cover plate, and rotatable relative thereto, at least two second vanes fixedly attached to the second shaft, the second vane subdividing the spaces into chambers, a plurality of ducts in the first end member and in the bottom of the rotor body, enabling communication, at predetermined angular relationships between the rotor body and the first end member, between the fluid-handling chambers and the outside of the machine, and cams adapted to act upon the second shaft and, thus, on the second vane to periodically accelerate them and periodically decelerate them, whereby the second vane is made to periodically increase the volumes of some of the chambers, while reducing the volumes of others.

7 Claims, 8 Drawing Sheets

ROTARY-VANE MACHINE

TECHNICAL FIELD

The invention relates to a rotary-vane machine for use as a compressor, a liquid pump or an internal combustion engine.

BACKGROUND ART

The disadvantages of the conventional reciprocating-piston internal combustion engine are well known: a low ratio of power developed to engine mass and limited efficiency due to loss of kinetic energy upon piston reversal between strokes. The same holds true also for piston compressors and pumps.

While V-type engines have a higher power/mass ratio, such designs as the Wankel engine have serious sealing problems even today.

In other known rotary-vane machines, essential components of the vane-controlling mechanism rotate at speeds much higher than the shaft speed of the machine, causing excessive wear and reducing the reliability and service life of the machines.

It is one of the objectives of the present invention to overcome the disadvantages of the prior-art machines and engines, and to provide a rotary-vane machine usable as compressor, pump or internal combustion engine that has a high output/mass ratio and suffers no kinetic-energy losses due to the need for stroke reversal; that has no components rotating at a speed substantially higher than the rotor shaft and encounters no serious sealing problems, and that uses few and relatively simple components.

SUMMARY OF THE INVENTION

According to the invention, this is achieved by providing a rotary-vane machine comprising a first and a second stationary end member fixedly connectable to one another at a predetermined distance; rotor means including a rotor body at least partly contacting one face of said first end member and having first shaft means rotatably mounted in said first end member; at least two first vane means located inside said cup-shaped rotor body and rigidly connected thereto so as to be stationary relative to said rotor body; a rotor cover plate fluid-tightly attachable to said rotor body and defining with said rotor body and said first vane means a plurality of fluid-handling spaces; second shaft means mounted in, and extending beyond, said rotor body and rotor cover plate, and rotatable relative thereto; at least two second vane means located inside said fluid-handling spaces of said rotor body and fixedly attached to said second shaft means, said second vane means subdividing said spaces into chambers; a plurality of duct means in said first end member and in the bottom of said cup-shaped rotor body, enabling communication, at predetermined angular relationships between said rotor and said first end member, between said fluid-handling chambers and the outside of said machine, and camming means comprising a stationary camming surface and a plurality of movable cam followers, said camming means, upon rotation of said rotor, being adapted to act upon said second shaft means and, thus, on said second vane means in such a way as to periodically accelerate them relative to the rotational speed of said rotor means and periodically decelerate them relative to said speed, whereby said second vane means are made to periodically increase the volumes of some of said chambers, while reducing the volumes of others of said chambers, the volume of each chamber being alternatingly increased and reduced.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 5:
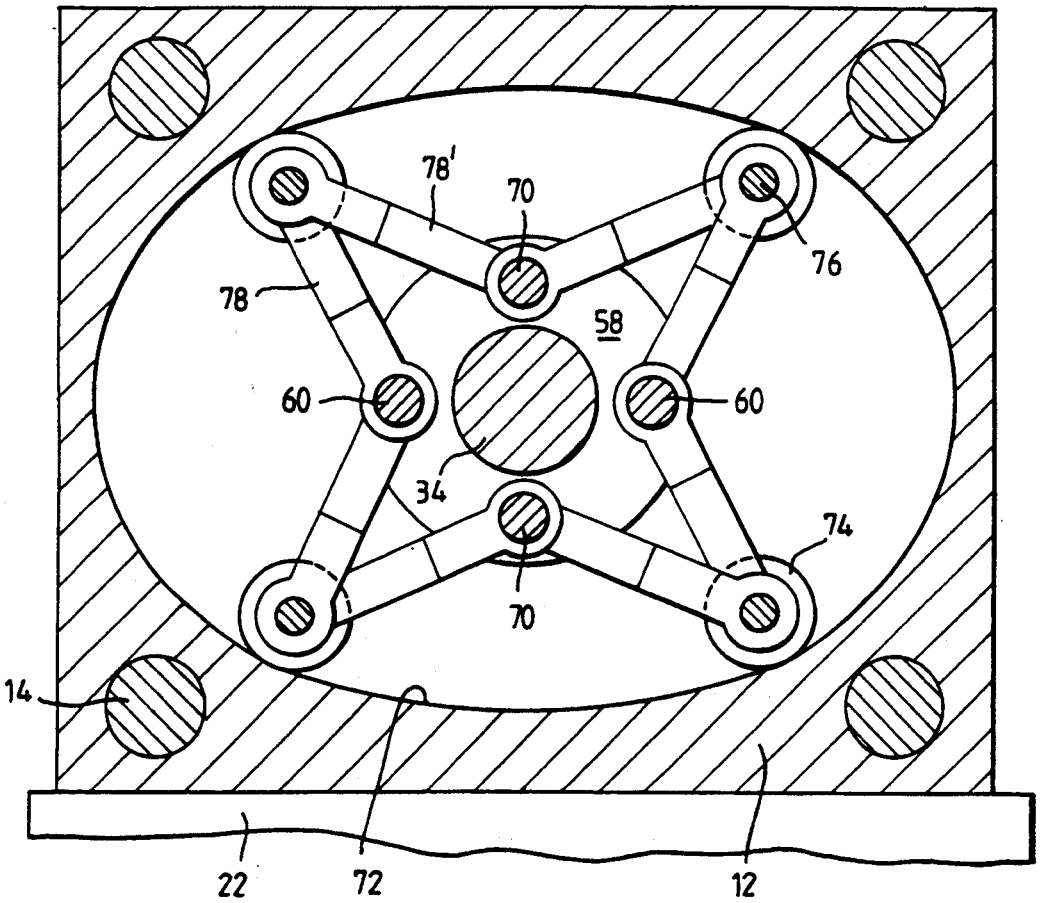
FIG. 5 is a view in cross section along plane V—V in FIG. 4.
Figure 8:
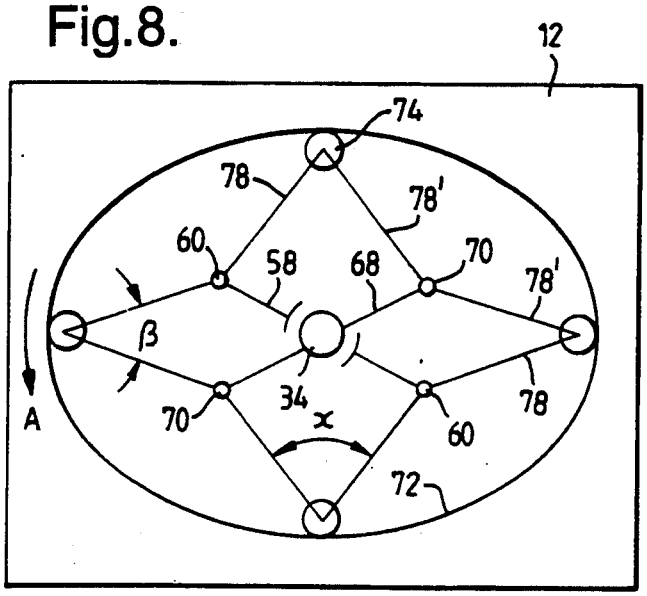
Figure 9:
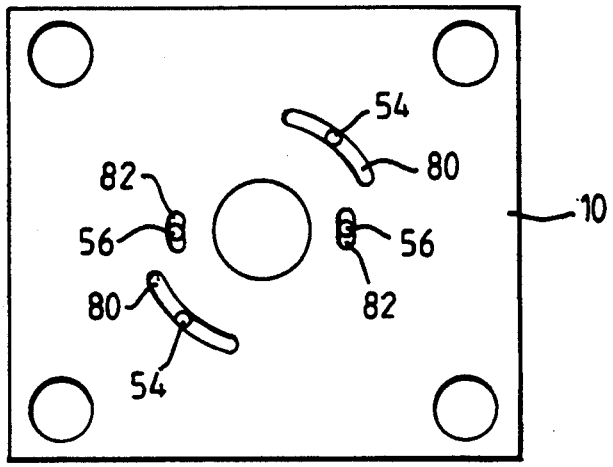
Figure 10:
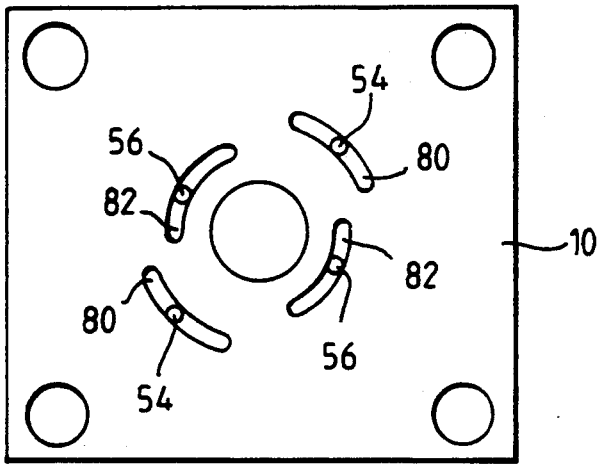
Figure 11:
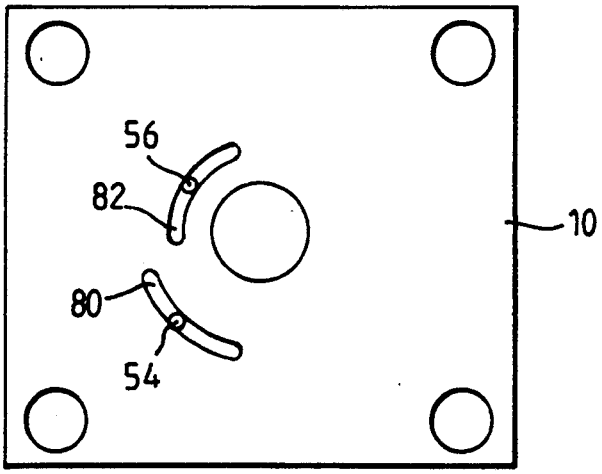
Figure 12:
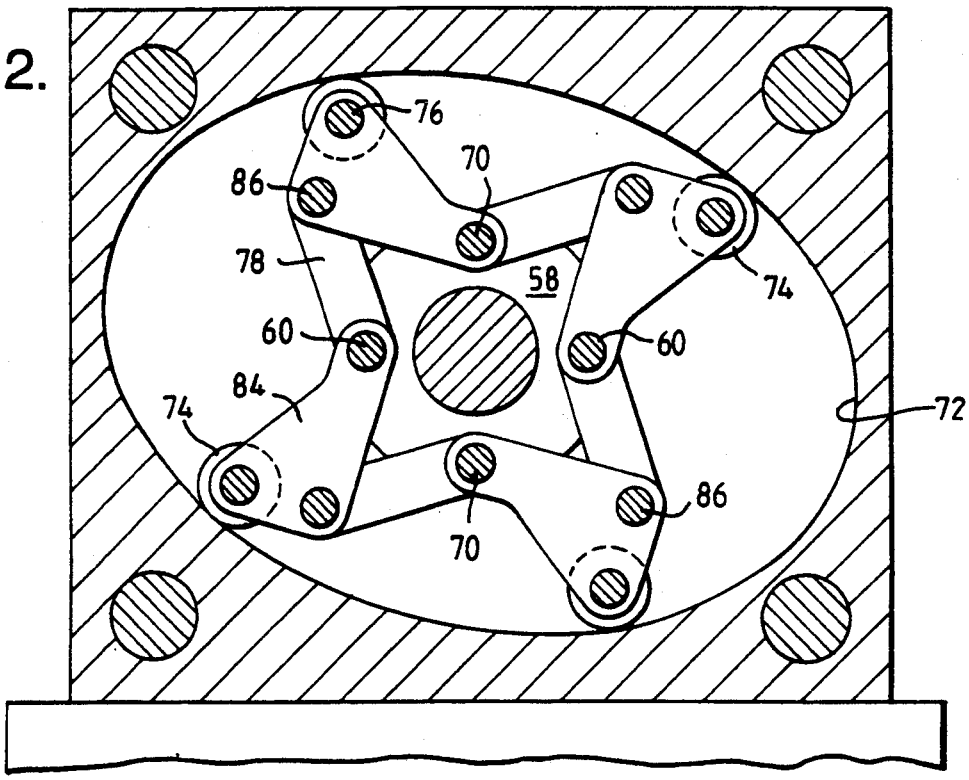
Figure 13:
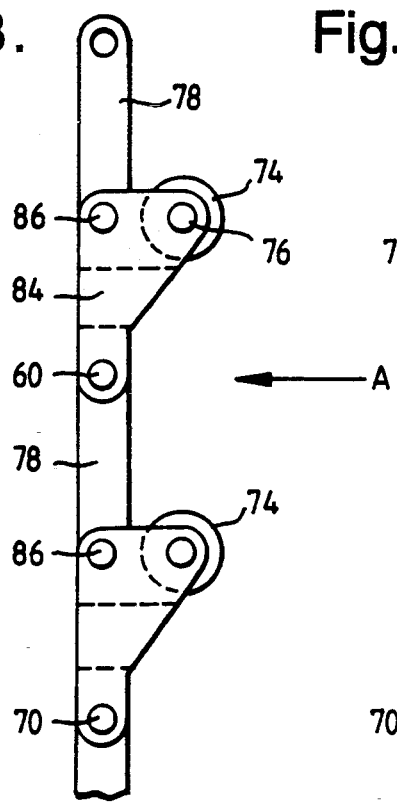
Figure 14:
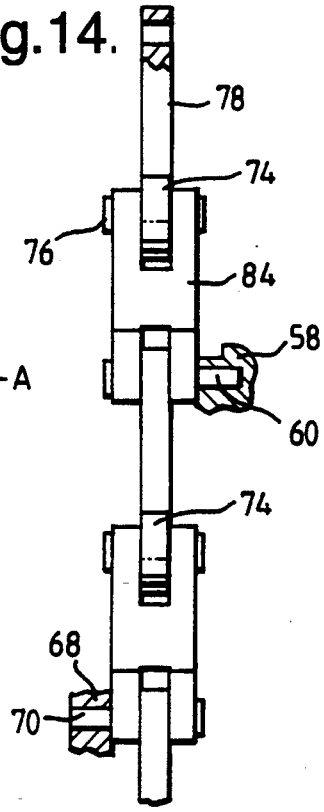
Figure 15:
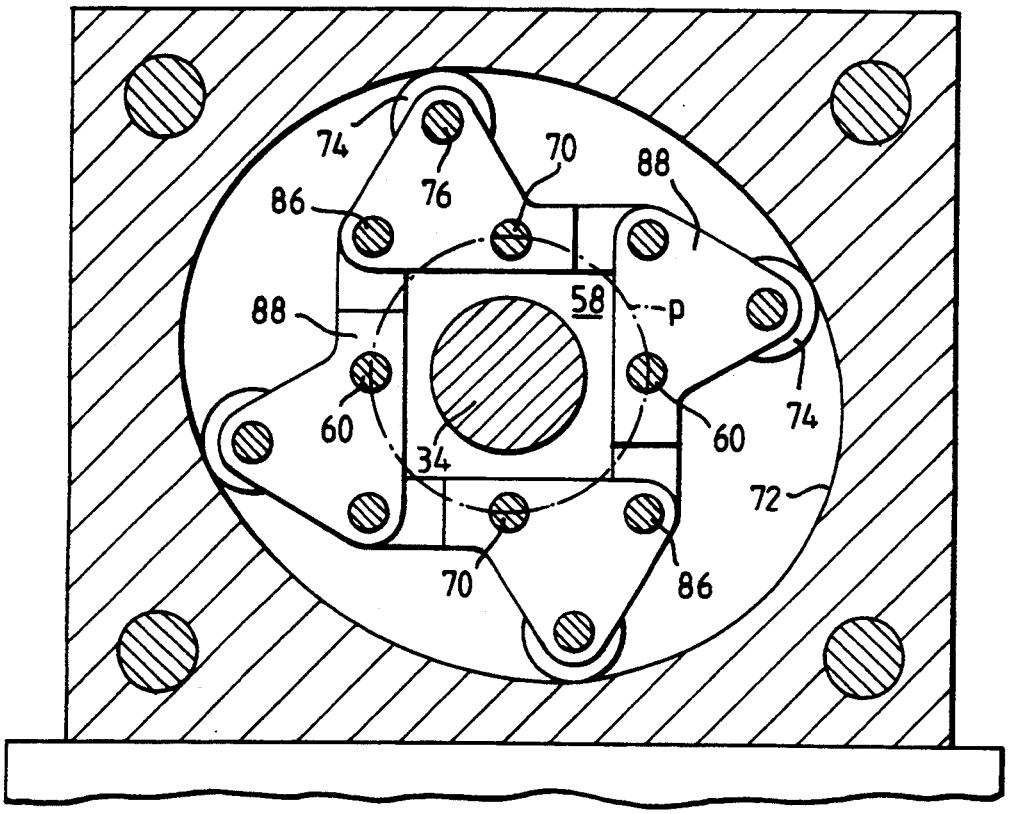
Figure 16:
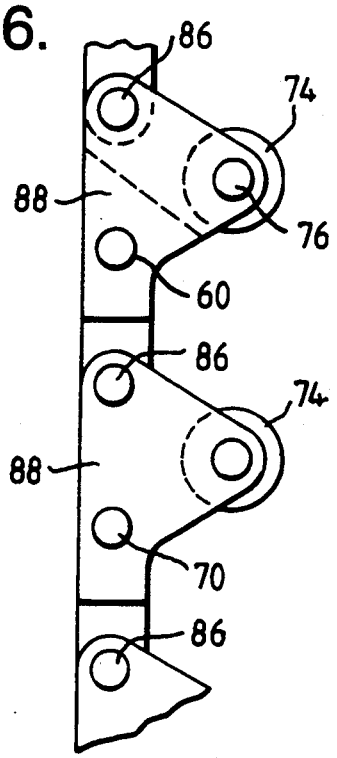

FIGS. *7a–7j* represent several phases of the oscillating vanes in correlation with corresponding positions of the camming mechanism;

FIG. 8 is a schematic drawing aiding in the explanation of the operation of the camming mechanism;

FIG. 9 shows the end plate for a compressor;

FIG. 10 represents the end plate for a liquid pump;

FIG. 11 shows the end plate for an internal combustion engine;

FIG. 12 illustrates another embodiment of the camming linkage of FIG. 5;

FIG. 13 is a developed view of some of the members of the camming linkage of FIG. 12;

FIG. 14 is a side view, in direction of arrow A, of the linkage members of FIG. 13;

FIG. 15 shows yet another embodiment of the camming linkage;

FIG. 16 is a developed view of some of the members of FIG. 15, and

Figure 17:
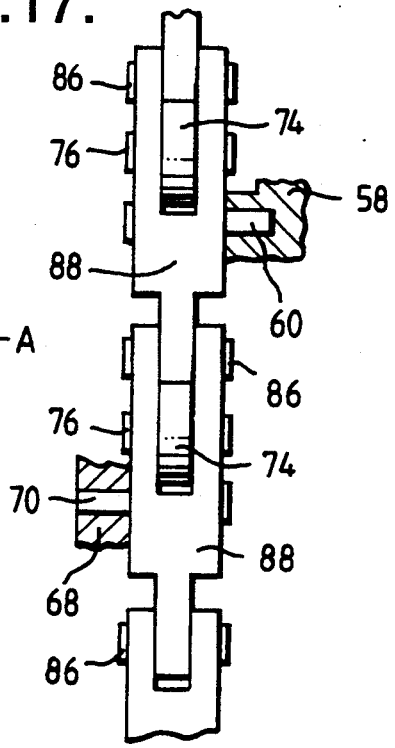

FIG. 17 is a side view, in direction of arrow A, of the linkage members of FIG. 16.

DETAILED DESCRIPTION OF THE INVENTION

Figure 1:
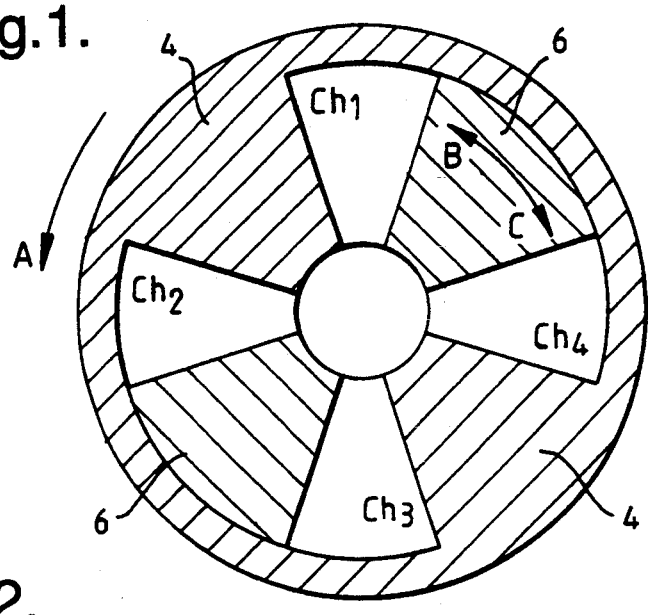
FIG. 1 is a schematic representation explaining the concept underlying the rotary-vane machine according to the invention.

The concept of the rotary-vane machine according to the invention is easily understood from the schematic drawing of FIG. 1.

There is seen a substantially cylindrical rotor 2 with two tapering vanes 4 which are stationary relative to the rotor 2, and a second pair of vanes 6 that, in principle, rotates together with the rotor 2, but on which a camming arrangement (to be explained in detail further below) alternatingly superposes an acceleration causing it to gain on the uniformly rotating rotor 2 (arrow A), followed by a deceleration causing it to lag behind the rotor 2. The vanes 6, firmly attached to a shaft 8 (which is controlled by the above-mentioned camming arrangement) thus perform an oscillatory movement relative to the rotor 2 (but not relative to a fixed reference point outside of the rotor) as indicated by the double arrow BC. Due to this oscillatory movement, the respective volumes of the chambers $Ch_1$, $Ch_2$, $Ch_3$, $Ch_4$, defined by the two pairs of vanes 4 and 6 continously vary: during the acceleration phase, when the vanes 6 gain on the rotor 2 (arrow B), the volumes of chambers $Ch_1$ and $Ch_3$ are reduced, while the volumes of chambers $Ch_2$ and $Ch_4$ increase; and during the deceleration phase, when the vanes 6 lag behind the rotor 2 (arrow C), the volumes of chambers $Ch_4$ and $Ch_2$ are reduced while the volumes of chambers $Ch_1$ and $Ch_3$ increase. Clearly, a shrinking cheer volume signifies a compression stroke, and an expanding volume signifies a suction stroke.

FIG. 1 does not show the various inlet and outlet ducts through which the working fluid enters and leaves the chambers $Ch_1$–$Ch_4$ in dependence on the position of the oscillating vanes 6 relative to the rotor vanes 4.

Figure 2:
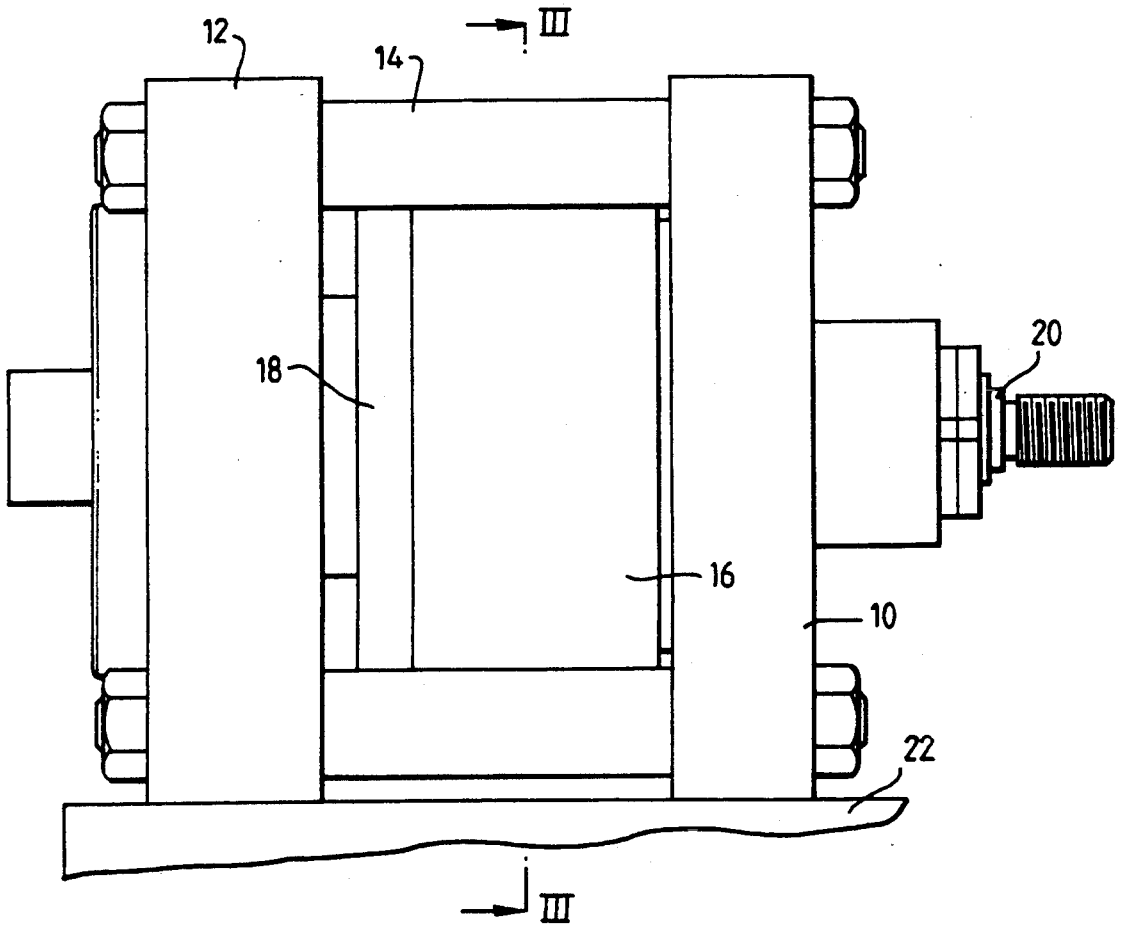
FIG. 2 shows the outer aspect of the machine.

The outer aspect of the rotary-vane machine is shown in FIG. 2. There is seen a first end plate 10 spaced apart from, and clamped to a second end plate 12 by means of tie rods 14, a rotor body 16 to which is fixedly attached a rotor cover plate or lid 18, and the end of a drive shaft 20 which is in fact an integral part of the rotor body 16. The entire machine is mounted on a common base 22.

Figure 3:
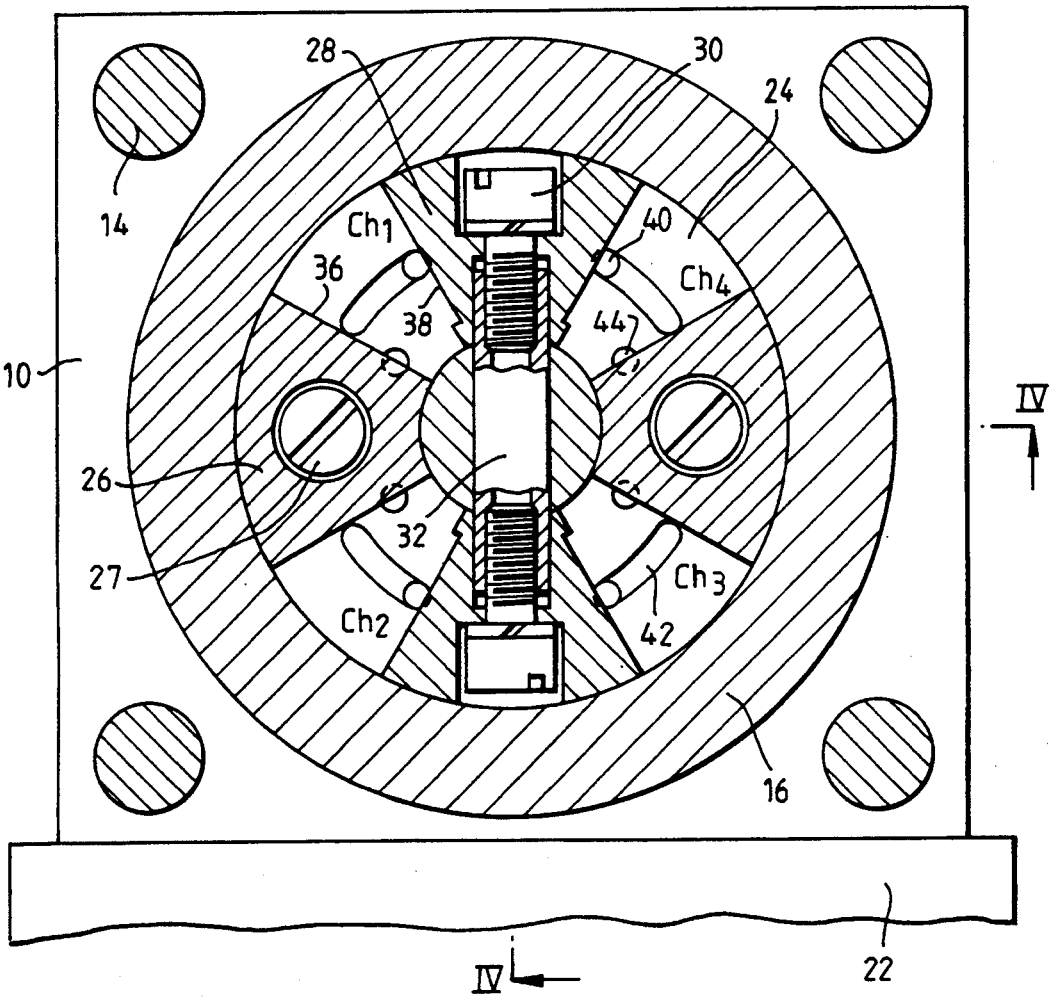
FIG. 3 is a view in cross section along plane III—III in FIG. 2.

FIG. 3, a view in cross section along plane III—III of FIG. 2, shows the rotor body 16, a cylindrical, cup-like structure, (see FIG. 4), the bottom 24 of which lies in a plane parallel to the plane of the paper. Seen also are the fixed vanes 26, fixedly attached to the rotor bottom 24 by means of screws 27. Further shown are the oscillating vanes 28 attached by means of screws 30 to a bar 32 and thereby pressed against a shaft 34 which, while coaxial with the above-mention ed drive shaft 20 (FIG. 2), can to some extent move independently of the latter.

As in the schematic drawing of FIG. 1, the fixed vanes 26 and the oscillating vanes 28 define between them chambers $Ch_1$, $Ch_2$, $Ch_3$ and $Ch_4$, the respective volumes of which vary as a function of the instantaneous position of the oscillating vanes 28 relative to the fixed vanes 26, as already explained in conjunction with FIG. 1.

While the lateral faces 36 of the fixed vanes 26 are plane, the lateral faces 38 of the oscillating vanes are advantageously stepped as seen in FIG. 3, to preclude a situation of zero volume of one of the chambers $Ch_1$–$Ch_4$.

Located along two concentric circles, there are seen on the outer circle four inlet ducts in the form of bores 40 passing through the bottom 24 of the rotor body 16 and adapted to communicate, at predetermined angular positions of the rotor body 16, with inlet ducts, to be described further below, of the end plate 10. Also seen are elongated, arcuate recesses 42 extending along the outer concentric circle from the bores 40 right to the lateral walls 36 of the fixed vanes 26. The purpose of these recesses 42 is to provide communication between the inlet bores 40 and those of the chambers $Ch_1$–$Ch_4$ which are at that stage of the suction stroke when the bores 40 are still covered by the oscillating vanes 28.

Along the inner concentric circle there are located four outlet ducts in the form of bores 44 which, like the inlet bores 40, are adapted to communicate, at predetermined angular positions of the rotor body 16, with outlet ducts of the end plate 10.

Figure 4:
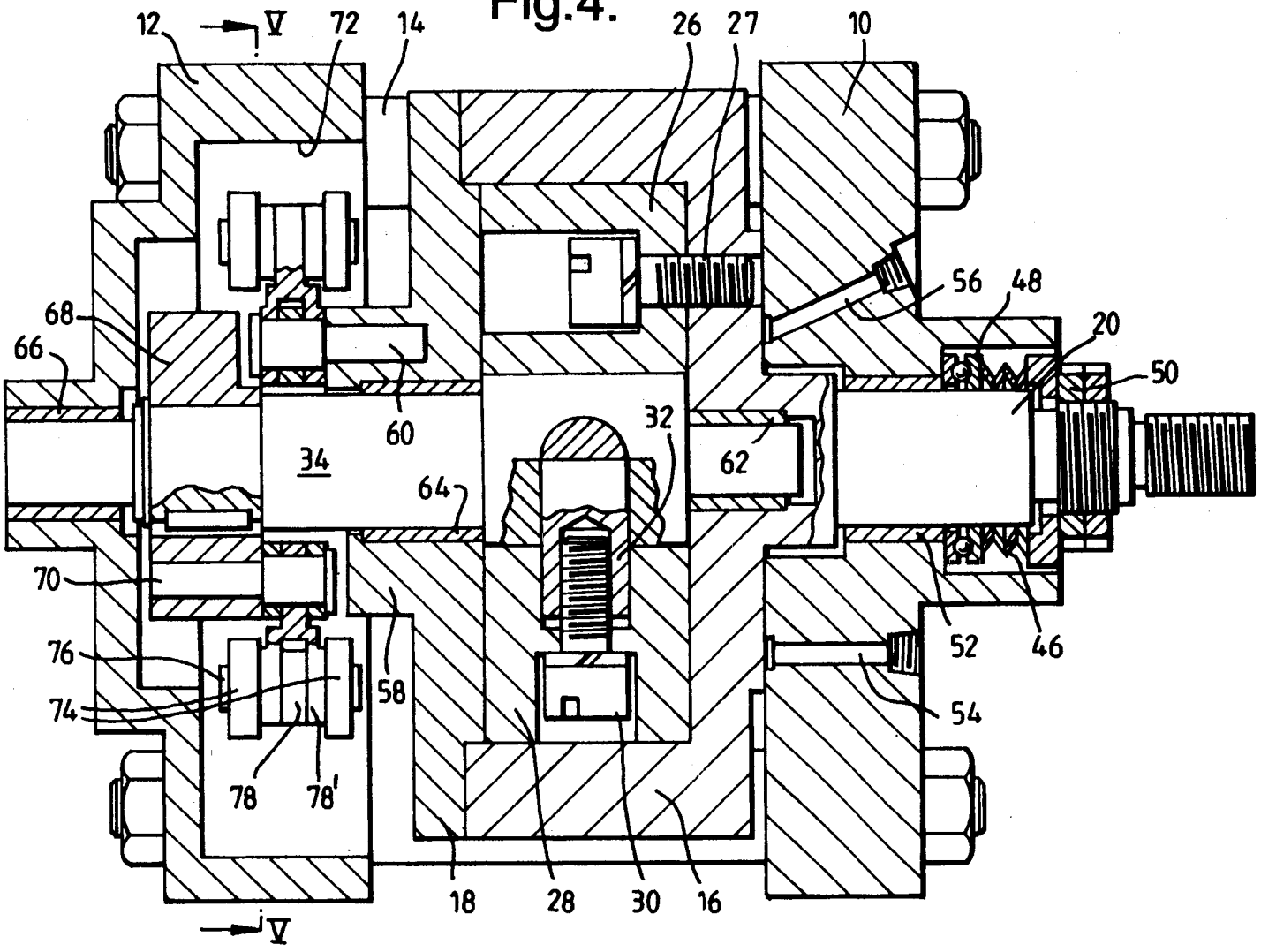
FIG. 4 is a view in folded-up cross section along plane IV—IV in FIG. 3.

FIG. 4 is a view, in folded-up, longitudinal cross-section along plane IV–IV in FIG. 3, of the machine according to the invention. Seen is the cup-shaped rotor body 16 and the rotor shaft 20 which, as already mentioned, is an integral part of the rotor body 16. During operation, the rotor body 16 must be tightly pressed against the face of the end plate 10. This is achieved by a number of disk springs 46 which, abutting against an axial bearing 48, pull the rotor body 16 against the end plate 10. The pulling force can be adjusted by a lockable nut 50. The shaft 20 rotates in an antifriction bearing 52 mounted in the end plate 10.

Seen in the end plate 10 are also one of two inlet ducts 54 and one of two outlet ducts 56.

Inside the rotor body 16 can be seen, above the center line, one of the fixed vanes 26 with screw 27 and, below the center line, one of the oscillating vanes 28 and part of the rod 24, as well as screw 32 ( it will be remembered that the upper half of the cross-section of FIG. 4 is folded-up, as indicated by the cross-sectional plane IV–IV in FIG. 3).

Shown is also the rotor lid 18 fixedly attached to the rotor body 16 and defining, together with the latter, the spaces in which the oscillating vanes 28 operate. The rotor lid 18 is also provided with a neck portion 58 carrying two pivots 60 (of which only one is visible in this view), the purpose of which becomes apparent further below.

Supported in a first bearing 62 in the rotor body 16, a second bearing 64 in the rotor lid 18, and a third bearing 66 in the end plate 12, there is seen the shaft 34 to which are fixedly attached the oscillating vanes 28. A collar 68 is keyed to a stepped-down portion of this shaft, carrying two pivots 70 (of which only one is visible) which, as will be presently seen, (together with the pivots 60 carried by the neck portion 58 of the rotor lid) are parts of the camming mechanism that produces the movement of the oscillatory vanes 28.

This camming mechanism is represented both in FIG. 4 and FIG. 5, and, as all camming mechanisms, comprises a cam and a cam follower or, in this case, several cam followers. The cam is here an internal cam with a curvilinear, oval camming surface or track 72, and the cam followers are roller pairs 74 connected by means of pivots 76 into a linkage consisting of forked levers 78, 78′ of uniform length. These levers are seen to better advantage in FIG. 6, which is a "developed" side view of two of them, as interlinked on one of their ends by the pivot 76 of a pair of rollers 74, and pivoted by pivots 60 and 70 to the neck portion 58 and the collar 68 respectively, on the other one of their ends.

The operation of the camming mechanism is illustrated in FIGS. *7a–7j* which, along a full "stroke" of the oscillating vane 28, correlate the respective positions of the rotor body 16, the oscillating vanes 28, the neck portion 58 of the rotor link and the collar 68 of the oscillating-vane shaft 34. Arrows A in FIGS. *7a* and *7b* indicate the sense of rotation.

Figure 7A:
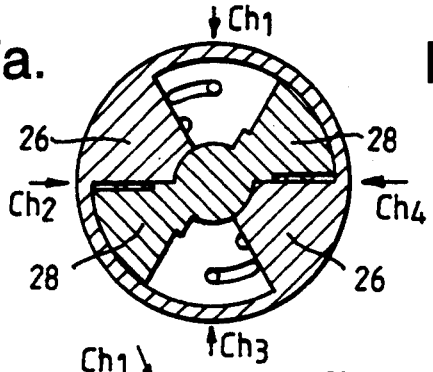
Figure 7B:
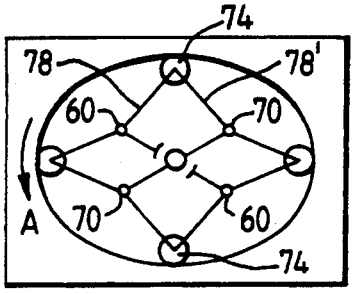
Figure 7C:
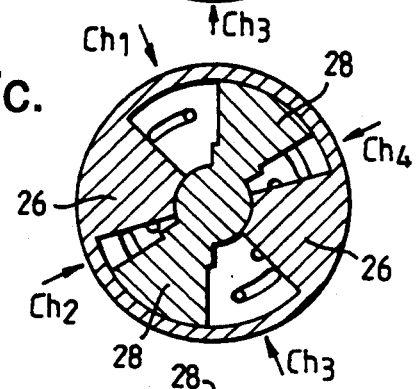
Figure 7D:
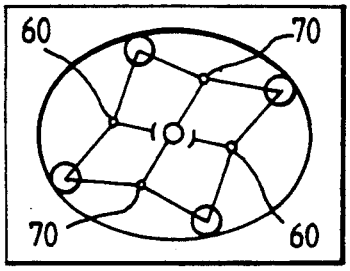
Figure 7E:
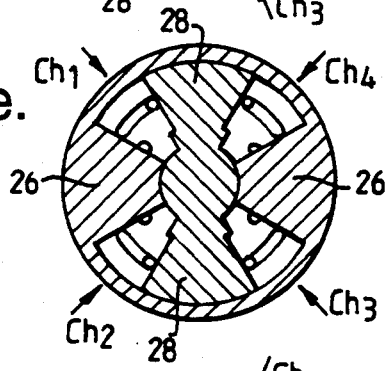
Figure 7F:
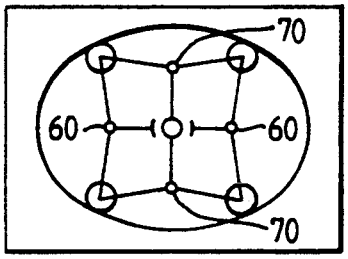
Figure 7G:
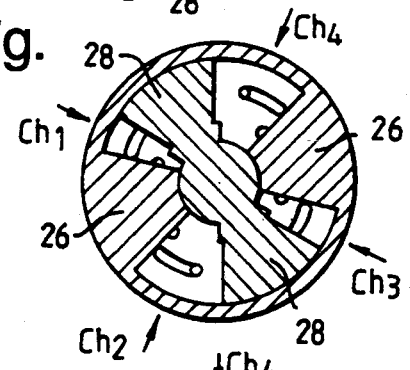
Figure 7H:
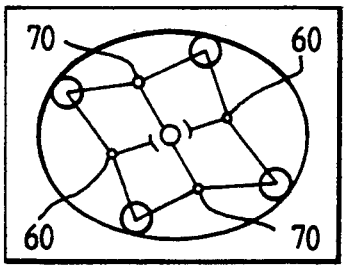
Figure 7I:
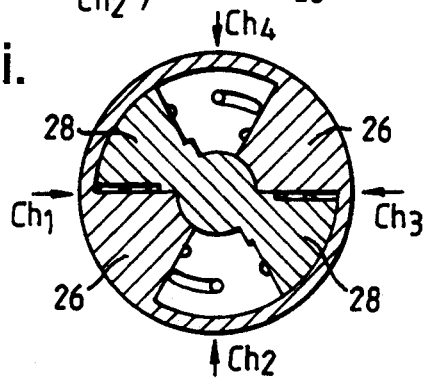
Figure 7J:
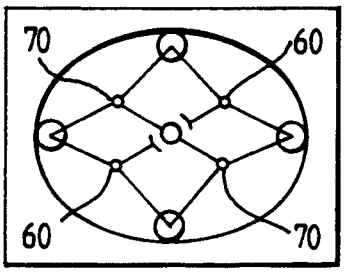

FIGS. *7a, 7c, 7e, 7g,* and *7i* represent five phases in the acceleration stage where, as already mentioned, the oscillating vanes 28 gain on the fixed vanes 26, starting from the position indicated in FIG. *7a,* where chambers $Ch_2$ and $Ch_4$ have their minimum size, i.e., their volumes are close to zero and cheers $Ch_1$ and $Ch_3$ are at their maximum size; via FIG. 7c, where, assuming the machine to be set up as compressor or pump, the double-acting oscillating vanes 28 have begun to produce suction in chambers $Ch_2$ and $Ch_4$ and compression, respectively expulsion, in chambers $Ch_1$ and $Ch_3$; via FIGS. 7e and 7g, where this process continues, until FIG. 7i, when $Ch_4, Ch_2 = max$, and $Ch_1$, $Ch_3 = min$.

From this point on begins the deceleration cycle of the oscillating vanes 28, the phases of which would look like those shown in FIGS. 7d–7j, except that the positions of the pivots 60 and 70, and their radial "appendices" 58 and 68 would be switched.

For a better understanding of the acceleration/deceleration mechanism and of the FIGS. 7b–7j, an explanation will be given with the aid of FIG. 8 which is a schematic representation of the camming mechanism.

There are seen the two pivots 60 mounted on the rotor-lid neck portion 58 (represented by the radial lines 58) and the pivots 70 mounted on the vane-shaft collar 68 (represented by the radial lines 68). There are further seen the four pairs of levers 78, 78' interlinked by rollers 74, lever 78 of each pair of levers being articulated to the rotor-lid neck portion 58 by the pivot 60 and lever 78' being articulated to the vane-shaft collar 68 by the pivot 70.

The pivots 60 and the ends of the levers 78 articulated to them are driven directly and at constant speed by the rotor body 16 and lid 58, while the pivots 70 which, via the collar 68 of the vane shaft 34, drive the oscillating vanes 28, are driven by the levers 78' articulated to these pivots 70.

The geometry of the linkage is very simple: four isosceles triangles with identical sides (levers 78, 78'), the apex-angles of which vary between a maximum and a minimum according to the position of the apices (=rollers 74) relative to the axes of the oval cam 72, with FIG. 8 representing one limit position and FIG. 7f (or FIG. 5) representing an intermediate position in which all apex angles are equal. Obviously the lengths of the bases of these triangles (=the imaginary lines connecting adjacent pivots 60 and 70) vary, too, between a maximum for an apex angle and a minimum for an apex angle. As one end point of these bases, the pivots 60, rotate at a constant speed, being directly connected to the rotor unit, it is the other ends of the bases, the pivots 70, controlling the vane shaft 34, that moves when the base length varies, superposing alternatingly an acceleration and a deceleration on the rotating vanes 28, thus producing the oscillatory movement of these vanes relative to the fixed vanes 26.

The rotary-vane machine according to the invention can be set up as a compressor, a pump and also as an internal combustion engine, with only one component different for each specific application. This component is the end plate 10 in FIGS. 9–11.

FIG. 9 shows the inside faces of the end plate 10 of the machine as used as compressor. The inlet and outlet bores and recesses are disposed along two concentric circles which are congruent with the pair of concentric circles mentioned in conjunction with FIG. 3.

There are seen, on the outer circle, two inlet or suction bores 54 leading to the outside of the end plate 10, as well as two arcuate recesses 80 that define the effective range of the suction stroke. Two suction and outlet bores are required because during one revolution of the rotor body 16, two suction and compression cycles take place in the chambers $Ch_1$–$Ch_4$.

On the inner one of the two concentric circles there are seen two outlet bores 56 and two recesses 82 which recesses, in order to achieve a high compression ratio, are relatively short.

The end plate suitable for a liquid-pump application is shown in FIG. 10. Seen on the outer circle are the two suction bores 54 and the two arcuate recesses 80, and on the inner circle, the two expulsion bores 56 and their recesses 82 which recesses, in this case, are of about the same length as the suction recesses, because of the incompressibility of liquids.

When the machine according to the invention serves as internal combustion engine, a different cycle takes place in each of the chambers $Ch_1$–$Ch_4$: $Ch_1$–induction; $Ch_2$–compression; $Ch_3$–power stroke; $Ch_4$–exhaust. There are therefore only two bores and recesses in the appropriate end plate (FIG. 11); an intake bore 54 and its recess 80, and an exhaust bore 56 and its recess 82. An opening (not shown) is provided for a spark plug to ignite the compressed fuel-air mixture provided by a carburetor (not shown).

Suitable materials or coatings should be selected for components in frictional contact.

Another embodiment of the camming arrangement is shown in FIGS. 12–14. Here, the linkage consists of four flat levers 78 interlinked by the longer limb of four bell-crank type levers 84, the shorter limbs of which, by means of pivot 76, carry cam-following rollers 74.

One end of the levers 78 is pivoted to the corner end of the longer limbs by means of pivots 86 and the other end of the levers 78, together with the other end of the longer limb is pivoted, alternatingly, to the rotor-lid neck portion by means of pivot 60, and to the vane shaft collar 68 by means of pivot 70.

Figure 6:
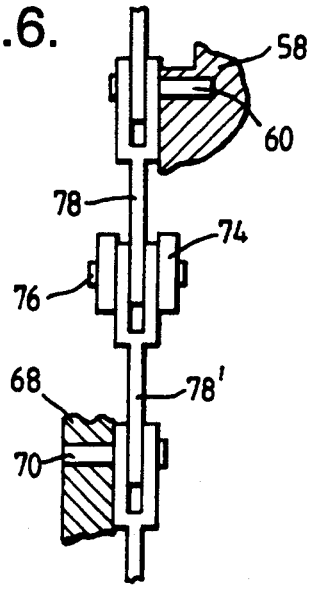
FIG. 6 shows a developed side view of some of the members of the camming linkage.

The advantage of this embodiment resides in the fact that it uses four single rollers 74 only, as against the four double rollers 74 of the previous embodiment (see FIG. 6). As a result, the oval camming track 72 can be much narrower than the track 72 of FIG. 5 which has to accommodate two rollers 74 mounted at a distance. As internal cams are difficult to produce in the best of cases, this design is of great help in producing the essential camming mechanism at reduced costs.

While the camming mechanisms represented in FIGS. 5 and 12 have both eight levers, the mechanism shown in FIGS. 15–17 requires only four levers and is therefore simpler and less expensive.

Seen in FIGS. 15–17 are four modified, slotted and tongued bell-crank levers 88 interlinked by means of pivots 86 and having each four bores, one of which, at the projecting end of one of the lever arms, accommodates a pivot 76 that carries the cam-following roller 74. The other three bores are located along a straight line, the outer two bores accommodating the above-mentioned pivots 86, while the inner bore which constitutes the lever fulcrum, accommodates the pivots 60 that articulate two of the levers 88 to the motor-lid neck portion 58, or the pivots 70 that articulate the other two lever 88 to the shaft collar 68. These three bores are equidistant, the distance between them equaling the radius of the pitch circle p, the center of which coincides with the axis of the shaft 34.

An embodiment would be feasible in which the driving element (in case of the machine acting as a compressor or pump) or the driven element (in case of the machine acting as internal combustion engine) is not attached to the end of shaft 20 (FIG. 4), but is advantageously flanged onto the left-side end of the machine.

The advantage of such an arrangement resides in the fact that the shaft 34, which is subject to periodically fluctuating loads due to the action of the camming mechanism, can be significantly shortened and that the connection between the rotor 16, the camming mechanism and the driving (or driven) element is now via shafts supported on both ends rather than via the cantilevered pivots 60. This design greatly reduces vibrations and thus permits the use of higher speeds.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A rotary-vane machine, comprising:

a first stationary end member and a second stationary end member, fixedly connectable to each other at a predetermined distance;

rotor means including a cup-shaped rotor body having a bottom and at least partly contacting one face of said first end member, and having a first shaft means rotatably mounted in said first end member;

at least two first vane means located inside said rotor body and rigidly connected thereto so as to be stationary relative to said rotor body;

a rotor cover plate fluid-tightly attachable to said rotor body and defining with said rotor body and said first vane means a plurality of fluid-handling chambers;

second shaft means mounted in, and extending beyond, said rotor body and rotor cover plate, and rotatable relative to said rotor body;

at least two second vane means located inside said fluid-handling chambers of said rotor body and fixedly attached to said second shaft means;

a plurality of duct means in said first end member and in the bottom of said rotor body, enabling communication, at predetermined angular relationships between said rotor and said first end member, between said fluid-handling chambers and an area outside of said machine, and camming means comprising a stationary camming surface and a plurality of movable cam followers, said camming means, upon rotation of said rotor means, being adapted to act upon said second shaft means and, thereby, on said second vane means so as to periodically accelerate said second vane means relative to the rotational speed of said rotor means and periodically decelerate said second vane means relative to said rotational speed, whereby said second vane means periodically increase the volumes of some of said chambers, while reducing the volumes of others of said chambers, the volume of each chamber being alternatingly increased and reduced wherein said cam followers comprise a plurality of levers arranged in pairs, the levers of each pair being interlinked at one of their ends by first pivot means carrying at least one roller adapted to roll along said cam surface, and being articulated at the other one of their ends to second and third pivot means, said second pivot means being fixedly attached to, and driven by, a portion of said rotor means, and said third pivot means being fixedly attached to, and adapted to act upon, a member integral with said second shaft means to the effect of periodically and alternatingly accelerate and decelerate said second vane means relative to the speed of said rotor means.

2. The machine as claimed in claim 1, wherein said cam followers comprise a plurality of slotted and tongued levers, each lever having at least four bores, of which one bore, disposed at the end of one arm of said lever, accommodates first pivot means carrying at least one roller adapted to roll along said cam surface, the other three bores being equidistantly disposed along a straight line, the outer ones of said three bores serving, in conjunction with second pivot means, to interlink said four levers and the inner one of said three bores serving as respective fulcrums of said levers, alternatingly accommodating third and fourth pivot means respectively attached to, and driven by, a portion of said motor means, and atttached to, and adapted to act upon, a member integral with said second shaft means.

3. A rotary-vane machine, comprising:

a first stationary end member and a second stationary end member, fixedly connectable to each other at a predetermined distance;

rotor means including a cup-shaped rotor body having a bottom and at least partly contacting one face of said first end member and having a first shaft means rotatably mounted in said first end member;

at least two first vane means located inside said rotor body and rigidly connected thereto so as to be stationary relative to said rotor body;

a rotor cover plate fluid-tightly attachable to said rotor body and defining with said rotor body and said first vane means a plurality of fluid-handling chambers;

second shaft means mounted ink, and extending beyond, said rotor body and rotor cover plate, and rotatable relative to said rotor body;

at least two second vane means located inside said fluid-handling chambers of said rotor body and fixedly attached to said second shaft means;

a plurality of duct means in said first end member and in the bottom of said rotor body, enabling communication, at predetermined angular relationships between said rotor and said first end member, between said fluid-handling chambers and an area outside of said machine, and camming means comprising a stationary camming surface and a plurality of movable cam followers, said camming means, upon rotation of said rotor means, being adapted to act upon said second shaft means and, thereby, on said second vane means so as to periodically accelerate said second vane means relative to the rotational speed of said rotor means and periodically decelerate said second vane means relative to said rotational speed, whereby said second vane means periodically increase the volumes of some of said chambers, while reducing the volumes of others of said chambers, the volume of each chamber being alternatingly increased and reduced, wherein said cam followers comprise a plurality of bell-crank type levers having first and second limbs, and a plurality of substantially flat levers having two ends articulated at one of their ends to one end of said first limbs and at the other one of their ends, together with the other end of said first limbs, to first and second pivot means respectively attached to, and driven by, a portion of said rotor means, and attached to, and adapted to act upon, a member integral with said second shaft means.

4. A rotary-vane machine, comprising:

a first stationary end member and a second stationary end member, fixedly connectable to each other at a predetermined distance;

rotor means including a cup-shaped rotor body having a bottom and at least partly contacting one face of said first end member and having a first shaft means rotatably mounted in said first end member;

at least two first vane means located inside said rotor body and rigidly connected thereto so as to be stationary relative to said rotor body;

a rotor cover plate fluid-tightly attachable to said rotor body and defining with said rotor body and said first vane means a plurality of fluid-handling chambers;

second shaft means mounted in, and extending beyond, said rotor body and rotor cover plate, and rotatable relative to said rotor body;

at least two second vane means located inside said fluid-handling chambers of said rotor body and fixedly attached to said second shaft means;

a plurality of duct means in said first end member and in the bottom of said rotor body, enabling communication, at predetermined angular relationships between said rotor and said first end member, between said fluid-handling chambers and an area outside of said machine, and camming means comprising a stationary camming surface and a plurality of movable cam followers, said camming means, upon rotation of said rotor means, being adapted to act upon said second shaft means and, thereby, on said second vane means so as to periodically accelerate said second vane means relative to the rotational speed of said rotor means and periodically decelerate said second vane means relative to said rotational speed, whereby said second vane means periodically increase the volumes of some of said chambers, while reducing the volumes of others of said chambers, the volume of each chamber being alternatingly increased and reduced, wherein said first end member is provided with two inlet ducts disposed at predetermined angular distances along a first circle in substantial alignment with the first circle of said rotor body, and with two outlet ducts disposed at predetermined angular distances along a second circle in substantial alignment with the second circle of said rotor.

5. A rotary-vane machine, comprising:

a first stationary end member and a second stationary end member, fixedly connectable to each other at a predetermined distance;

rotor means including a cup-shaped rotor body having a bottom and at least partly contacting one face of said first end member and having a first shaft means rotatably mounted in said first end member;

at least two first vane means located inside said rotor body and rigidly connected thereto so as to be stationary relative to said rotor body;

a rotor cover plate fluid-tightly attachable to said rotor body and defining with said rotor body and said first vane means a plurality of fluid-handling chambers;

second shaft means mounted in, and extending beyond, said rotor body and rotor cover plate, and rotatable relative to said rotor body;

at least two second vane means located inside said fluid-handling chambers of said rotor body and fixedly attached to said second shaft means;

a plurality of duct means in said first end member and in the bottom of said rotor body, enabling communication, at predetermined angular relationships between said rotor and said first end member, between said fluid-handling chambers and an area outside of said machine, and camming means comprising a stationary camming surface and a plurality of movable cam followers, said camming means, upon rotation of said rotor means, being adapted to act upon said second shaft means and, thereby, on said second vane means so as to periodically accelerate said second vane means relative to the rotational speed of said rotor means and periodically decelerate said second vane means relative to said rotational speed, whereby said second vane means periodically increase the volumes of some of said chambers, while reducing the volumes of others of said chambers, the volume of each chamber being alternatingly increased and reduced, wherein said first end member is provided with one inlet and one outlet duct only.

6. A rotary-vane machine, comprising:

a first stationary end member and a second stationary end member, fixedly connectable to each other at a predetermined distance;

rotor means including a cup-shaped rotor body having a bottom and at least partly contacting one face of said first end member and having a first shaft means rotatably mounted in said first end member;

at least two first vane means located inside said rotor body and rigidly connected thereto so as to be stationary relative to said rotor body;

a rotor cover plate fluid-tightly attachable to said rotor body and defining with said rotor body and said first vane means a plurality of fluid-handling chambers;

second shaft means mounted in, and extending beyond, said rotor body and rotor cover plate, and rotatable relative to said rotor body;

at least two second vane means located inside said fluid-handling chambers of said rotor body and fixedly attached to said second shaft means;

a plurality of duct means in said first end member and in the bottom of said rotor body, enabling communication, at predetermined angular relationships between said rotor and said first end member, between said fluid-handling chambers and an area outside of said machine, and camming means comprising a stationary camming surface and a plurality of movable cam followers, said camming means, upon rotation of said rotor means, being adapted to act upon said second shaft means and, thereby, on said second vane means so as to periodically accelerate said second vane means relative to the rotational speed of said rotor means and periodically decelerate said second vane means relative to said rotational speed, whereby said second vane means periodically increase the volumes of some of said chambers, while reducing the volumes of others of said chambers, the volume of each chamber being alternatingly increased and reduced, wherein said bottom of said rotor body is provided with four inlet ducts disposed at predetermined angular distances along a first circle concentric with said rotor body, and four outlet ducts disposed at predetermined angular distances along a second circle, said first and said second circle being concentric.

7. The machine as claimed in claim 6, wherein at least some of said ducts in said rotor body bottom and said end member further include arcuate recesses disposed along said first and second circles and extending for predetermined angular distances.

* * * * *